US009537234B2

(12) United States Patent
Brodsky et al.

(10) Patent No.: US 9,537,234 B2
(45) Date of Patent: Jan. 3, 2017

(54) METHOD OF MAKING A SOLDER TAIL EXTENDER CONNECTOR

(71) Applicant: GLOBALFOUNDRIES Inc., Grand Cayman (KY)

(72) Inventors: William L. Brodsky, Binghamton, NY (US); John R. Dangler, Rochester, MN (US); Mark K. Hoffmeyer, Rochester, MN (US); Timothy P. Younger, Rochester, MN (US)

(73) Assignee: GLOBALFOUNDRIES Inc., Grand Cayman (KY)

( * ) Notice: Subject to any disclaimer, the term of this patent is extended or adjusted under 35 U.S.C. 154(b) by 585 days.

(21) Appl. No.: 13/962,046

(22) Filed: Aug. 8, 2013

(65) Prior Publication Data

US 2015/0041212 A1 Feb. 12, 2015

(51) Int. Cl.
*H01R 4/02* (2006.01)
*H01R 12/58* (2011.01)

(52) U.S. Cl.
CPC ..... *H01R 12/585* (2013.01); *H01R 4/02* (2013.01)

(58) Field of Classification Search
CPC ..... H01R 12/04; H01R 43/0235; H01R 43/04; H01R 4/02; H01R 12/585
See application file for complete search history.

(56) References Cited

U.S. PATENT DOCUMENTS

| | | | | |
|---|---|---|---|---|
| 3,849,870 | A | 11/1974 | Cobaugh et al. | |
| 3,864,014 | A | 2/1975 | Lynch | |
| 4,644,643 | A | 2/1987 | Sudo | |
| 4,723,925 | A | 2/1988 | Orr, Jr. et al. | |
| 4,984,359 | A | 1/1991 | Clark | |
| 5,575,666 | A | 11/1996 | Dent | |
| 5,772,451 | A * | 6/1998 | Dozier, II | B23K 20/004 257/E21.503 |
| 6,095,842 | A | 8/2000 | Lin | |
| 6,353,191 | B1 * | 3/2002 | Harper, Jr. | H05K 3/3426 174/267 |
| 2001/0049213 | A1 * | 12/2001 | Potters | H01R 13/41 439/80 |
| 2004/0259434 | A1 | 12/2004 | Pitzele | |
| 2007/0148819 | A1 * | 6/2007 | Haba | H01L 25/105 438/107 |
| 2008/0318453 | A1 | 12/2008 | Dancison | |
| 2009/0239398 | A1 | 9/2009 | Lynch et al. | |
| 2010/0015822 | A1 | 1/2010 | Morgan et al. | |

* cited by examiner

*Primary Examiner* — Carl Arbes
(74) *Attorney, Agent, or Firm* — Heslin Rothenberg Farley & Mesiti P.C.

(57) ABSTRACT

A solder tail extender connector and method are provided for implementing production of solder tail extender connectors from compliant pins. A forming fixture is provided to collapse compliant pins prior to soldering. The compliant pin is collapsed at or beyond the normal compliant pin low end dimensions and removed from the forming fixture. A solder tail extender optionally is added to the collapsed compliant pin, forming the solder tail extender connector.

10 Claims, 3 Drawing Sheets

METHOD OF MAKING A SOLDER TAIL EXTENDER CONNECTOR

FIELD OF THE INVENTION

The present invention relates generally to the data processing field, and more particularly, relates to a solder tail connector and method for implementing production of solder tail extender connectors from compliant pin connectors.

DESCRIPTION OF THE RELATED ART

New connector systems such as Impact™ connector systems are often offered with compliant pins but not solder tail versions. Solder tail versions are often used in flex cross sections. Providing tooling for solder tail versions of compliant pin connectors is expensive and solder tail lengths are limited.

Complaint pin versions are often used in thick rigid cards to be able to meet the electrical stub reduction requirements as signal speeds continue to increase.

Flex cross sections can be converted to rigid flex by adding rigid materials so the compliant pin can reside in a rigid portion of the cross section. This arrangement adds cost, complexity to the flex design, and signal integrity concerns due to material changes within layers and increased stub length.

Paste in hole or wave solder with oversized vias can be used with existing compliant pin connectors, but compliant pin lengths are short so pins may not extend through the cross section. As such, this construction does not allow for clear visual inspection of solder joints, and as a result requires x-ray inspection. Oversized vias have adverse cost, raw substrate manufacturability, reliability, and signal integrity (SI) impacts.

A need exists for methods to enable effective use of compliant pin connectors for solder tail applications.

SUMMARY OF THE INVENTION

Principal aspects of the present invention are to provide a solder tail extender connector and method for implementing production of solder tail connectors from compliant pin connectors. Other important aspects of the present invention are to provide such method, and solder tail extender connector substantially without negative effects and that overcome many of the disadvantages of prior art arrangements.

In brief, a solder tail extender connector and method are provided for implementing production of solder tail extender connectors from compliant pins. A forming fixture is provided to collapse compliant pins prior to soldering. The compliant pin is collapsed at or beyond the normal compliant pin low end dimensions and removed from the forming fixture. A solder tail extender optionally is added to the collapsed compliant pin, forming the solder tail extender connector.

In accordance with features of the invention, the methods convert compliant pins to solder tail extender connector without significant additional tooling expenses.

In accordance with features of the invention, the solder tail extender connector enables use with a minimum via size, improving wire-ability, raw substrate manufacturability, reliability and signal integrity performance.

In accordance with features of the invention, the compliant pin includes a selected plating or coating, and the solder tail extender includes a selected plating or coating internally and externally with the selected material to facilitate solder wicking or a selected material that will reflow during connector processing.

In accordance with features of the invention, the solder tail extender includes a selected shape, such as a cylindrical shape or split shape for insertion onto the collapsed compliant pin.

In accordance with features of the invention, the solder tail extender includes a selected solder tail length to form the solder tail extender connector allowing proper stick through for wave solder and visual inspection.

In accordance with features of the invention, the solder tail extender optionally includes additional holes to allow for solder entry.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a solder tail extender connector and method are provided for implementing production of solder tail extender connectors from compliant pins.

In accordance with features of the invention, the method is a low cost method to modify compliant pins for use in solder tail applications. The solder tail extender connector enables a reduced required via size, improving wire-ability, raw substrate manufacturability, reliability, cost, and signal integrity (SI) performance. Also via size in flex drives channel to channel cross-talk. By collapsing the compliant pins and reducing via size, the cross-talk is minimized improving system design margin which is critical for many flex designs. The solder tail extender connector provides a customizable solder tail length that allows proper stick through for wave soldering and visual inspection.

Figure 1:
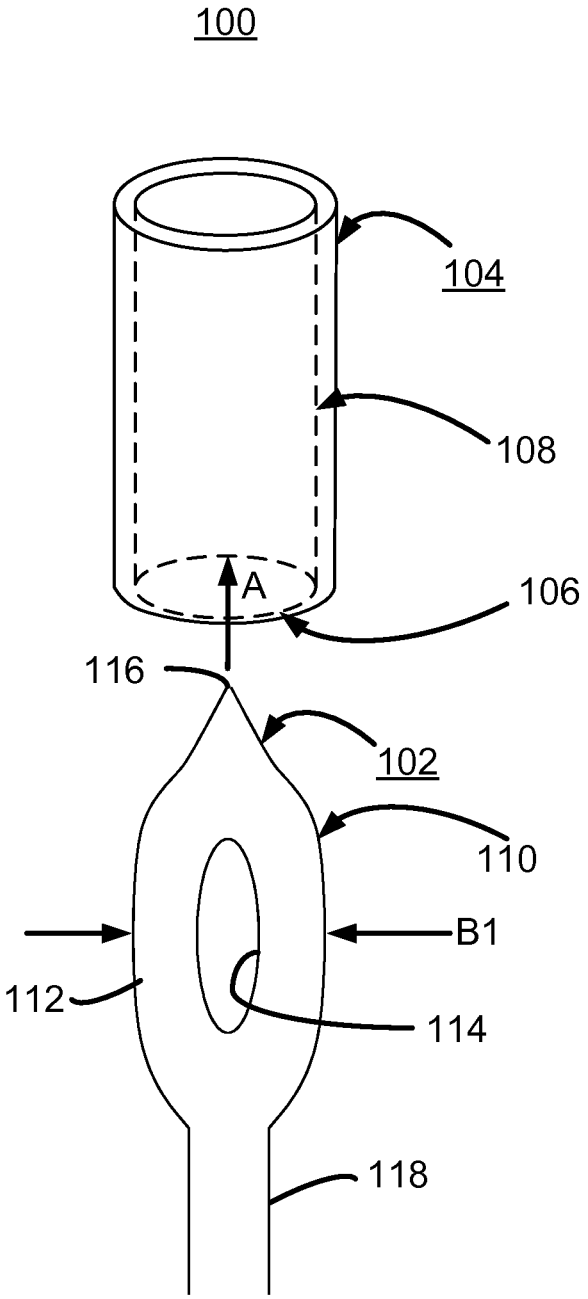
FIG. 1 schematically illustrates an example initial step in the production of solder tail extender connectors including an example compliant pin provided together with an example forming fixture used to collapse the compliant pin in accordance with the preferred embodiment.

Having reference now to the drawings, in FIG. 1, there is shown an example initial step in the production of solder tail connectors from compliant pins generally designated by the reference character 100 including an example compliant pin 102 together with an example forming fixture 104 provided to collapse the compliant pin 102 in accordance with the preferred embodiment.

Figure 2:
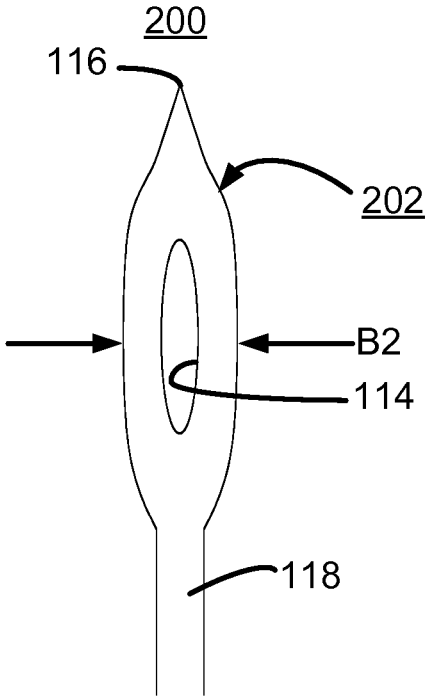
FIG. 2 schematically illustrates an example next step in the production of solder tail extender connectors including an example collapsed compliant pin removed from the forming fixture of FIG. 1 in accordance with the preferred embodiment.

The forming fixture 104 includes a selected bottom edge contour 106 and a selected contoured length 108 for a specific application to collapse the compliant pin 102 before soldering. The compliant pin 102 is inserted into the forming fixture 104 as indicated by an arrow labeled A to be collapsed or formed, and then is removed the forming fixture 104. As illustrated in FIG. 2, the compliant pin 102 is collapsed at or beyond standard or normal compliant pin low end dimensions.

The compliant pin 102 has a predefined shape 110 including a compliant section 112 having a central slot or cavity 114, a tapered end or tip 116 and an opposed base or post 118. The compliant pin 102 includes an initial diameter indicated by an arrow B1, such as 0.019". The compliant pin 102 includes a plating or coating, such as a tin/nickel coating or a gold/nickel coating. The compliant pin 102 withstands the insertion and removal from the forming fixture 104 without compromising coating integrity.

The insertion and removal of the compliant pin 102 from the forming fixture 104 can cause wear to the compliant pin plating finish, while not exposing the undercoat of the compliant pin. The material selection and contouring selection of the forming tool enables use of existing compliant pin metallurgy without being compromised.

Referring to FIG. 2, there is shown an example next step in the production of solder tail connectors generally designated by the reference character 200 including an example collapsed compliant pin 202 shown after being removed from the forming fixture of FIG. 1 in accordance with the preferred embodiment. The compliant pin 202 includes a collapsed diameter indicated by an arrow B2, such as 0.013".

Figure 3A:
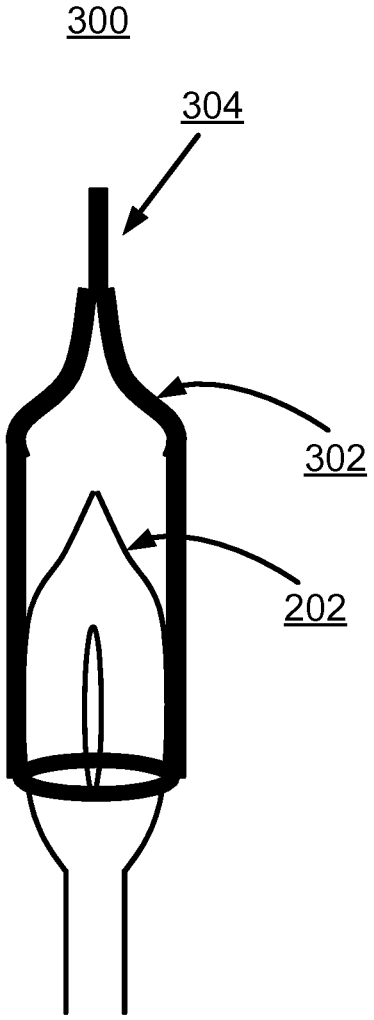
FIG. 3A schematically illustrates an example next step in the production of solder tail extender connectors including an example solder tail extender added to the collapsed compliant pin, forming an example solder tail extender connector in accordance with the preferred embodiment.

Referring to FIG. 3A, there is shown an example next step in the production of solder tail connectors generally designated by the reference character 300 including an example solder tail extender 302 added to the collapsed compliant pin 202 forming an example solder tail extender connector 304.

The solder tail extender 302 has a selected size and shape for a particular application, such as cylindrical or other shape, and for example, split for insertion onto the collapsed compliant pin 202. The solder tail extender 302 has a selected length for a particular application to enable proper stick through for wave solder and visual inspection. The solder tail extender 302 includes a selected plating or coating, such as a tin/nickel coating or a gold/nickel coating.

Figure 3B:
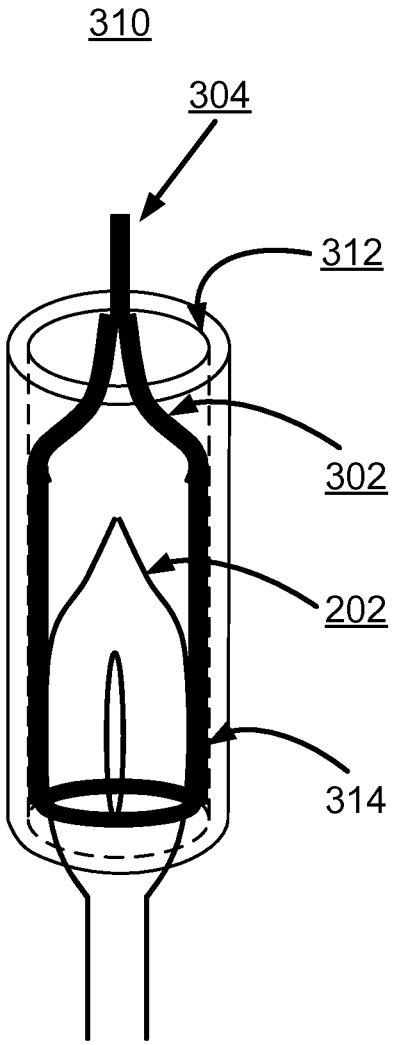
FIG. 3B schematically illustrates an example use of the example solder tail extender connector in use inserted within an example via in accordance with the preferred embodiment.

Referring to FIG. 3B, there is shown an example use generally designated by the reference character 310 of the solder tail extender connector 304 in use inserted within an example via 312 in accordance with the preferred embodiment. The via 312 has a selected diameter, such as selectively provided for receiving the solder tail extender connector 304 in loose engagement or sliding engagement.

Figure 4:
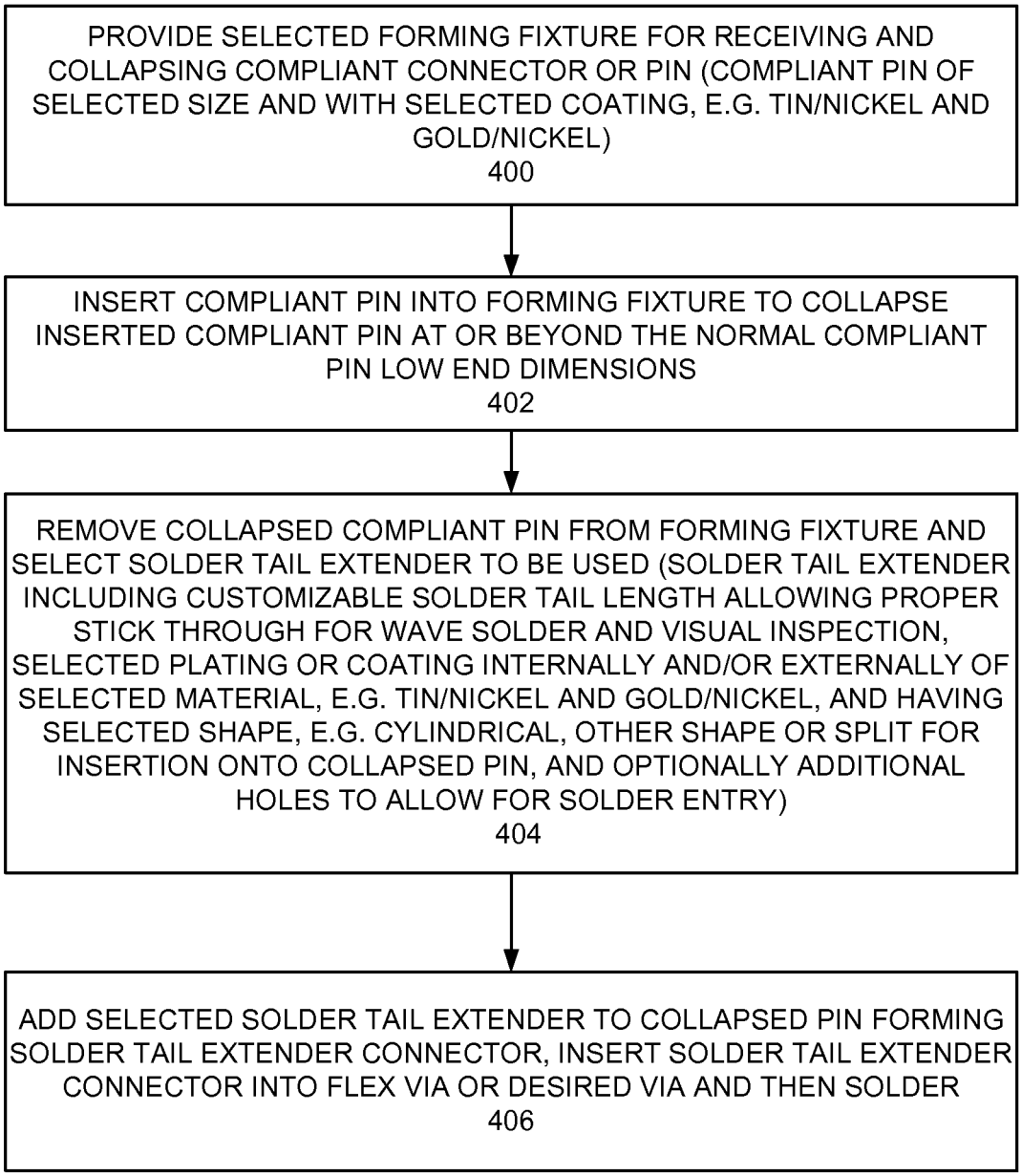
FIG. 4 is a flow chart illustrating exemplary operations for implementing production of solder tail connectors from compliant pins in accordance with the preferred embodiment.

Referring to FIG. 4, there are shown exemplary operations for implementing production of solder tail connectors from compliant pin connectors in accordance with the preferred embodiment.

As indicated in a block 400, a selected forming fixture is provided for receiving and forming a compliant pin, for example as illustrated and described above with respect to FIG. 1. Next as indicated in a block 402, a compliant pin is inserted into the forming fixture to collapse the inserted compliant pin at or beyond the normal compliant pin low end dimensions, for example as further illustrated and described with respect to FIG. 2.

As indicated in a block 404, the collapsed compliant pin is removed from the forming fixture, such as illustrated and described above with respect to FIG. 2, and a solder tail extender connector is selected to be used with the collapsed compliant pin, for example as illustrated and described above with respect to FIG. 3A.

As indicated in a block 406, the selected solder tail extender is added to the collapsed compliant pin forming the solder tail extender connector, and the solder tail extender connector is inserted into a flex via or other desired via, to then be soldered, for example, as illustrated and described with respect to FIGS. 3A and 3B.

While the present invention has been described with reference to the details of the embodiments of the invention shown in the drawing, these details are not intended to limit the scope of the invention as claimed in the appended claims.

What is claimed is:

1. A method for implementing production of solder tail extender connectors from compliant pin comprising:

providing a forming fixture to collapse a compliant pin;

collapsing the compliant pin in the forming fixture;

removing the collapsed compliant pin from the forming fixture; and adding a solder tail extender to the collapsed compliant pin, forming the solder tail extender connector.

2. The method as recited in claim 1 wherein adding said solder tail extender to the collapsed compliant pin includes providing said solder tail extender with a selected shape for insertion onto the collapsed compliant pin.

3. The method as recited in claim 1 wherein adding a solder tail extender to the collapsed compliant pin includes providing each of said solder tail extender and the compliant pin with a selected coating material.

4. The method as recited in claim 1 wherein adding a solder tail extender to the collapsed compliant pin include providing said solder tail extender including a selected length for forming the solder tail extender connector for wave soldering use.

5. The method as recited in claim 1 wherein adding a solder tail extender to the collapsed compliant pin includes providing said solder tail extender including a selected coating material internally and externally.

6. The method as recited in claim 1 wherein adding a solder tail extender to the collapsed compliant pin includes providing said solder tail extender including a selected shape and size.

7. The method as recited in claim 6 includes providing said solder tail extender having a cylindrical shape for insertion onto the collapsed compliant pin.

8. The method as recited in claim 6 providing said solder tail extender having a split shape for insertion onto the collapsed compliant pin.

9. The method as recited in claim 1 includes inserting the solder tail extender connector into a flex via, and soldering the inserted solder tail extender connector.

10. A method for implementing production of solder tail extender connectors from compliant pins comprising:

providing a forming fixture having a selected bottom edge contour and a selected contoured length to receive a compliant pin and collapse the compliant pin;

collapsing the compliant pin in the forming fixture to predefined compliant pin dimensions, said collapsed compliant pin having a predefined shape;

removing the collapsed compliant pin from the forming fixture; and adding a solder tail extender to the collapsed compliant pin, forming the solder tail extender connector, said solder tail extender having a selected length to enable visual soldering inspection of the solder tail extender connector.

* * * * *